United States Patent [19]

Thornley et al.

[11] Patent Number: 4,884,368

[45] Date of Patent: Dec. 5, 1989

[54] MEANS FOR FORCING APART TWO STRUCTURAL MEMBERS OF A CLOSURE ARRANGEMENT

[75] Inventors: David J. Thornley, Ryton; Moira A. Smith, Newcastle; Philip Dale, Hexham; Samuel H. Leask, South Shields; Ian M. Coutts, Preston Grange, all of United Kingdom

[73] Assignee: The Marconi Company Limited, Stanmore, United Kingdom

[21] Appl. No.: 295,694

[22] Filed: Jan. 10, 1989

[30] Foreign Application Priority Data

Jan. 13, 1988 [GB] United Kingdom ..... 8800725

[51] Int. Cl.[4] ..... E05F 11/00

[52] U.S. Cl. ..... 49/276; 174/35 MS; 292/DIG. 72

[58] Field of Search ..... 49/276, 506; 292/DIG. 72, 92; 174/35 MS

[56] References Cited

U.S. PATENT DOCUMENTS

| | | | |
|---|---|---|---|
| 1,594,019 | 7/1926 | Shea | 49/276 X |
| 1,889,221 | 11/1932 | Schleicher et al. | 49/276 |
| 2,746,782 | 5/1956 | Schamotta | 49/276 X |
| 3,040,392 | 6/1962 | Beauchamp | 49/276 |
| 4,011,688 | 3/1977 | Geiss | 49/276 X |

FOREIGN PATENT DOCUMENTS 604999 7/1948 United Kingdom .

*Primary Examiner*—Philip C. Kannan

[57] ABSTRACT

An ice breaker arrangement of forcing open the door of an enclosure such as a radio frequency shelter for electrical equipment comprises a threaded stud (3) which, when turned by a key, is made to project from the door frame (5) so as to force a reaction plate (2) attached to the door (1) away from the frame, thus opening the door (1). Appropriate apertures (21, 73) are provided at each end of the stud (3) to allow access to the stud (3) by the key.

10 Claims, 1 Drawing Sheet

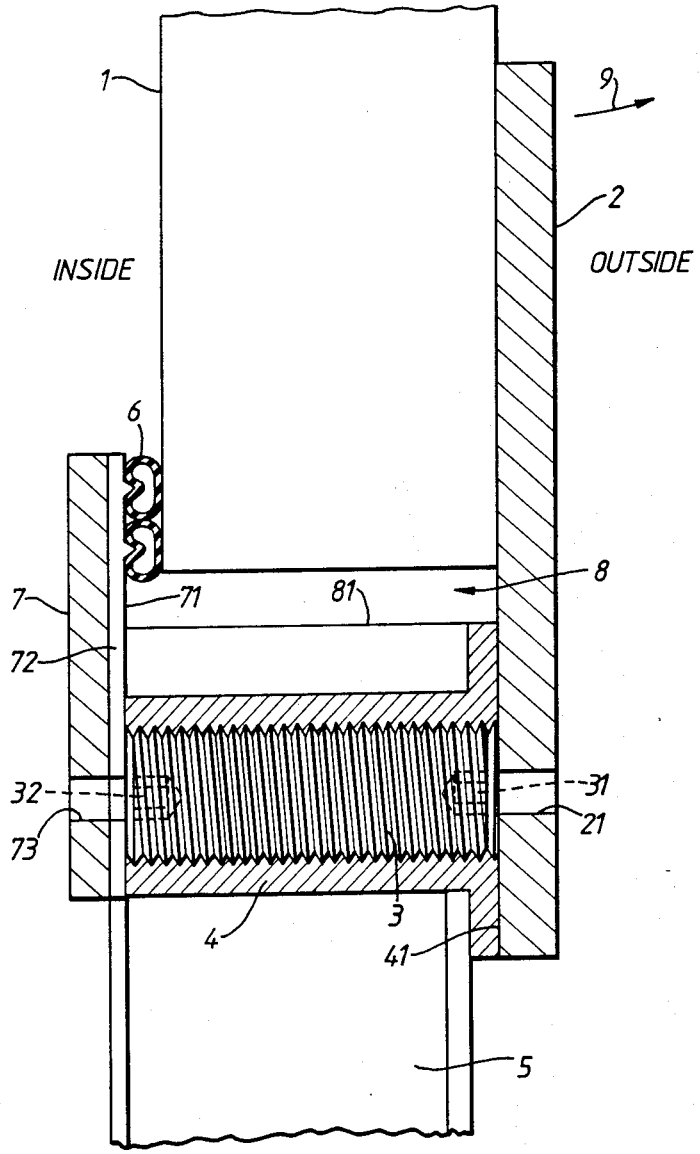
1
9
2
INSIDE
OUTSIDE
6
8
7
71
81
72
32
31
21
73
3
4
41
5

MEANS FOR FORCING APART TWO STRUCTURAL MEMBERS OF A CLOSURE ARRANGEMENT

BACKGROUND OF THE INVENTION

Field of the Invention

This invention relates to a closure arrangement having means for forcing apart two structural members of the arrangement. The invention is particularly useful as an ice breaking assembly for forcing open a door of an enclosure such as a shelter for electrical equipment from radio-frequency radiation.

SUMMARY OF THE INVENTION

The invention provides a closure arrangement comprising: first and second structural members having mutually engageable edges and being relatively moveable between an open position, at which the edges are spaced apart, and a closed position, at which the edges are in overlapping engagement in a plane normal to the direction in which they first separate when moved towards their open position; a resiliently deformable seal fixed to one of the structure members; and a stud in threaded engagement with a bore in the edge of the first structural member for free rotation therein such that, in use, its rotation causes an axial end face of the stud to project from the surface of the edge of the first structural member and to bear upon the edge of the second structural member thereby forcing apart the first and second structural members.

The structural members preferably comprise panel members of an enclosure. In one example, the first structural member is a wall of the enclosure and the second structural member is door hinged to an opening in the wall.

According to a second aspect, the invention provides a method of forcing apart two structural members whose edges are in mutual engagement, one of the structural members having a stud mounted in its edge for relative rotation, comprising rotating the stud to cause it to be displaced axially so that its end face projects from the surface of the edge to bear against the edge of the other structural member.

One way in which the invention may be performed will now be described, by way of example only, with reference to the accompanying drawing.

DESCRIPTION OF THE DRAWINGS

FIG. 1 is a partial horizontal section taken through a door and a door frame forming part of a transportable shelter for electrical equipment.

DESCRIPTION OF PREFERRED EMBODIMENT

A generally box-shaped enclosure is formed of panel members and is electrically conductive throughout its outer surface so as to absorb all incident RF (radio frequency) radiation, thus shielding the contents of the enclosure from such radiation. The enclosure is used as a transportable shelter for electrical equipment.

Access to the interior is obtained through a door 1, hinged along a vertical edge to a front wall of the enclosure defining a door frame 5. The door is opened and closed by means of a handle (not shown) on the vertical edge of the door 1 remote from the hinge. This edge of the door 1, as shown in the drawing, fits into a rebate 8 in the frame 5, against which it is sealed by an RF seal 6. The rebate 8 is defined by a vertical edge face 81 of the frame 5 and by an inner surface 71 of a panel 72 secured along the vertical edge of the frame 5.

A reaction plate 2 is secured to the outside of the edge of the door 1 so that, when the door is closed as shown in the drawing, a portion of the reaction plate 2 projects over the door frame 5.

An internally screw-threaded seating 4 is mounted in a horizontal bore through the edge of the frame 5 so that its exterior face 41 engages the projecting interior surface of the reaction plate 2 when the door is closed. A stud 3 is supported in the seating 4 in screw-threaded engagement. The stud 3 has hexagonal depressions 31, 32 at each end on its axis, to enable the stud to be turned about its axis by an externally-applied allen key. In order to allow access to the stud 3 from either the inside or the outside of the enclosure, an aperture 21 is provided through the reaction plate 2, and a corresponding aperture 73 is provided through a reinforcement plate 7 and through the panel 72 to which it is secured.

In use, in the event that the door cannot be opened in the direction of the arrow 9 by pulling on the handle in the usual manner, for example if ice has formed around the door frame, the door may be forced open by inserting an Allen key into either of the depressions 31 and 32, i.e. from the outside or the inside, to turn the stud 3. Turning the stud 3 in the appropriate sense causes it to project axially from its seating 3 to engage the reaction plate 2 and thus to push the reaction plate 2 away from the door frame 5.

By making the hexagonal depressions 31, 32 the same size, the same key can be used for forcing open the door from either the inside or the outside.

Although the stud, in this example, is carried by the door frame, it will be appreciated that it could equally well be carried by the door, the reaction plate being carried by the door frame. Further, the reaction plate could take an alternative form such as a bar, and could even be integral with the door or frame. Alternative means for turning the stud could of course be used.

What we claim is:

1. A closure arrangement comprising: first and second structural members having mutually engageable edges and being relatively moveable between an open position, at which the edges are spaced apart, and a closed position, at which the edges are in overlapping engagement in a plane normal to the direction in which they first separate when moved towards their open position; a resiliently deformable seal fixed to one of the structural members; and a stud in threaded engagement with a bore in the edge of the first structural member for free rotation therein such that, in use, its rotation causes an axial end face of the stud to project from the surface of the edge of the first structural member and to bear upon the edge of the second structural member thereby forcing apart the first and second structural members.

2. A closure arrangement according to claim 1, in which the structural members comprise panel members of an enclosure.

3. A closure arrangement according to claim 2, in which the first structural member is a wall of the enclosure and the second structural member is a door hinged to the opening in the wall.

4. A closure arrangement according to claim 2, in which the second structural member is a wall of the enclosure and the first structural member is a door hinged to an opening in the wall.

5. A closure arrangement according to claim 2, in which the edge of the second structural member is formed by a reaction member secured to the corresponding panel member, such that the reaction member and not the said panel member is capable of overlapping with the first structural member.

6. A closure arrangement according to claim 1, in which the stud has a formation in at least one of its end faces for engagement with a tool from a side of the edge of the first structural member, whereby the stud may be rotated.

7. A closure arrangement according to claim 6, in which the stud has a similar formation in its other end face to enable the tool to turn the stud from either side of the edge of the first structural member.

8. A closure arrangement according to claim 6, in which the edge of the second structural member has an aperture to enable the tool to gain access to a portion of the said end face of the stud to turn it when it is in engagement with the edge of the second structural member.

9. A closure arrangement according to claim 8 in which the stud has a similar formation in its other end face to enable the tool to turn the stud from either side of the edge of the first structural member.

10. A method of forcing apart two structural members whose edges are in mutual engagement, one of the structural members having a stud mounted in its edge for relative rotation, comprising rotating the stud to cause it to be displaced axially so that its end face projects from the surface of the edge to bear against the edge of the other structural member.

* * * * *